US007997203B1

(12) United States Patent
Macri

(10) Patent No.: US 7,997,203 B1
(45) Date of Patent: Aug. 16, 2011

(54) EMBEDDED AND REMOVABLE INITIATOR FOR EXPLOSIVES

(75) Inventor: John J. Macri, Nanjemoy, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 816 days.

(21) Appl. No.: 11/894,625

(22) Filed: Aug. 21, 2007

(51) Int. Cl.
*F42B 3/10* (2006.01)

(52) U.S. Cl. ..... 102/202.12; 102/202.5; 102/202.14; 102/481; 102/275.4; 102/275.5

(58) Field of Classification Search ..... 102/202.5, 102/202.9, 202.12, 202.14, 473, 481, 275.1, 102/275.4, 275.5, 275.6, 275.8, 275.11
See application file for complete search history.

(56) References Cited

U.S. PATENT DOCUMENTS

| | | | | | |
|---|---|---|---|---|---|
| 2,350,181 | A | | 5/1944 | Morgan | |
| 2,448,658 | A | | 9/1948 | Carey | |
| 2,960,000 | A | | 11/1960 | Thomas | |
| 2,982,210 | A | * | 5/1961 | Andrew et al. | 102/275.8 |
| 3,371,606 | A | | 3/1968 | Cook et al. | |
| 3,695,178 | A | * | 10/1972 | Betts | 102/202.9 |
| 3,726,220 | A | * | 4/1973 | MacDonald et al. | 60/39.47 |
| 3,865,035 | A | * | 2/1975 | Munson et al. | 102/364 |
| 3,978,796 | A | | 9/1976 | Hackman | |
| 4,147,108 | A | | 4/1979 | Gore et al. | |
| 4,621,578 | A | * | 11/1986 | Vallieres et al. | 102/202.9 |
| 4,660,472 | A | * | 4/1987 | Stevens | 102/202.1 |
| 4,667,599 | A | | 5/1987 | Brand | |
| 4,760,795 | A | | 8/1988 | Young | |
| 4,823,701 | A | | 4/1989 | Wilhelm | |
| 4,991,511 | A | * | 2/1991 | Simpson | 102/275.6 |
| 5,062,485 | A | * | 11/1991 | Wesson et al. | 166/297 |
| 5,069,131 | A | | 12/1991 | Kennedy et al. | |
| 5,223,664 | A | * | 6/1993 | Rogers | 102/275.1 |
| 5,435,250 | A | | 7/1995 | Pollock | |
| 5,714,712 | A | * | 2/1998 | Ewick et al. | 102/311 |
| 5,758,432 | A | | 6/1998 | Landman | |
| 5,898,123 | A | * | 4/1999 | Fritz et al. | 102/378 |
| 6,026,750 | A | | 2/2000 | Nelson | |
| 6,508,177 | B1 | | 1/2003 | Badger et al. | |
| 6,540,176 | B2 | * | 4/2003 | Davis et al. | 244/3.24 |
| 6,880,465 | B2 | * | 4/2005 | Badger et al. | 102/275.7 |
| 7,430,963 | B2 | * | 10/2008 | Hennings et al. | 102/202.5 |
| 7,472,652 | B1 | * | 1/2009 | Scheid | 102/331 |
| 2003/0177935 | A1 | | 9/2003 | Spivak et al. | |
| 2009/0193992 | A1 | * | 8/2009 | Moore | 102/206 |
| 2009/0235837 | A1 | * | 9/2009 | Scheid | 102/322 |

OTHER PUBLICATIONS

U.S. Appl. No. 11/894,626, filed Aug. 21, 2007, John J. Macri.

* cited by examiner

*Primary Examiner* — Bret Hayes
*Assistant Examiner* — Michael D David
(74) *Attorney, Agent, or Firm* — Fredric J. Zimmerman

(57) ABSTRACT

A warhead including a case, a main explosive being received within the case, an initiator having at least a portion embedded within a main explosive charge, and a releasable coupling intermediate the main explosive charge and the initiator.

28 Claims, 12 Drawing Sheets

EMBEDDED AND REMOVABLE INITIATOR FOR EXPLOSIVES

STATEMENT OF GOVERNMENT INTEREST

The invention described herein may be manufactured and used by or for the Government of the United States of America for government purposes without the payment of any royalties therefor.

BACKGROUND AND SUMMARY OF THE INVENTION

The present invention relates generally to explosive warheads and, more particularly, to methods and apparatus for embedding an initiator within a main explosive charge and the warheads formed thereby.

As illustrated in FIG. 1, it is known to provide a warhead 10 including a fixed initiator 12. More particularly, the initiator 12 usually includes an initiator charge 14 coupled to a safe/arm device (not shown) through a precision initiating coupling (PIC) 16. The initiator charge 14 is typically in a fixed position by being rigidly coupled to the warhead case 20. As is known, the initiator charge 14 is configured to bridge a gap 22 and detonate a main explosive charge 24. The gap 22 between the initiator charge 14 and the main explosive charge 24 may degrade the performance of the warhead 10.

Another known warhead 30 is shown in FIG. 2 as including an initiator 32 which is configured to move longitudinally within the case 20. More particularly, the initiator housing 34 is rigidly coupled to the warhead case 20 and defines a chamber or passageway 36 in which the initiator 32 floats. As such, the initiator 32 may move up and down within its housing 34 to maintain contact with the main explosive charge 24. In certain instances, springs 38 may be used to exert a downward force against the initiator 32, thereby facilitating contact between the initiator and the explosive charge 24. As noted above, maintaining contact between the initiator 32 and the main explosive charge 24 may be important, particularly when using a weaker initiator 32, in order to provide satisfactory performance of the main explosive charge 24 or when greater initiation precision is desired.

With reference now to FIG. 3, in order to facilitate contact between the initiator 32 and the main explosive charge 24, it is known to use an end former 38 for casting a precision upper surface 40 on the main explosive charge 24. Spruel holes 42 may be utilized to either cast liquid explosive 24 through the end former 38 or permit the discharge of excess liquid explosive 24 therethrough.

There remains a need for a warhead with increased performance through consistently reliable and precise initiation of the main explosive charge and, more particularly, by allowing the initiator to maintain full and continuous contact with the main explosive charge as the relative position between the case and upper surface of the main explosive charge changes. There is also a need to simplify and economize production of warheads by eliminating the need to end form a precision upper surface on the main explosive charge. There is a further need to permit initiator removal and replacement while maintaining the main explosive charge within the case. There is also a need to improve the safety of warheads by protecting the relatively sensitive initiator from the case of the warhead.

According to an illustrative embodiment of the present disclosure, an explosive warhead includes a case defining a longitudinal axis, and a main explosive charge received within the case. An explosive initiator includes an embedded portion received within the main explosive charge. A coupler is positioned intermediate the main explosive charge and the embedded portion of the initiator, and releasably couples the initiator to the main explosive charge. The explosive initiator maintains continuous contact with the main explosive charge by moving longitudinally with the main explosive charge during thermal expansion and contraction. Illustratively, the coupler includes a plurality of threads formed within the main explosive charge, and a plurality of mating threads supported by the embedded portion of the initiator.

According to another illustrative embodiment of the present disclosure, an explosive warhead includes a case defining a longitudinal axis, a main explosive charge received within the case, and an explosive initiator which includes an embedded portion received within the main explosive charge. A longitudinally extending spruel hole is formed within the initiator and receives a portion of the main explosive charge.

According to a further illustrative embodiment of the present disclosure, an explosive warhead includes a case, a main explosive charge received within the case, and an explosive initiator including an embedded portion received within the main explosive charge. A ullage is disposed intermediate the explosive initiator and the case, wherein the explosive initiator maintains continuous contact with the main explosive charge by moving within the ullage during thermal expansion and contraction of the main explosive charge.

According to yet another illustrative embodiment of the present disclosure, a method of forming an explosive warhead includes the steps of providing a case, coupling an initiator to a placement fixture, and positioning the placement fixture such that the initiator is suspended within a liquid explosive received within the case. The method further includes the step of curing the liquid explosive to a hardened condition such that the initiator is at least partially embedded within and supported by the explosive.

According to a further illustrative embodiment of the present disclosure, a method of forming an explosive warhead includes the steps of providing a case, coupling an initiator to a placement fixture, and positioning the placement fixture such that the initiator is suspended within the case. The method further includes the steps of casting a liquid explosive within the case, such that at least a portion of the initiator is received within the liquid explosive when suspended within the case by the placement fixture, and curing the liquid explosive to a hardened condition, such that the initiator is at least partially embedded within and supported by the explosive.

According to a further illustrative embodiment of the present disclosure, a method of forming an explosive warhead includes the steps of providing a case, providing an initiator including threads, and coupling the initiator to a placement fixture. The method further includes the steps of coupling the placement fixture to the case such that the initiator is suspended within the case, and casting a liquid explosive within the case, such that at least a portion of the initiator is received within the liquid explosive when suspended within the case by the placement fixture. The method further includes the steps of heating the liquid explosive such that the explosive hardens, the initiator is at least partially embedded within and supported by the explosive, and mating threads are formed within the explosive and cooperate with the threads of the initiator. The method further includes the steps of uncoupling the initiator from the placement fixture after the explosive hardens, cooling the explosive after uncoupling the initiator, such that the initiator moves with the explosive in response to thermal contraction, and uncoupling the placement fixture from the case.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE INVENTION

The embodiments of the invention described herein are not intended to be exhaustive or to limit the invention to precise forms disclosed. Rather, the embodiments selected for description have been chosen to enable one skilled in the art to practice the invention.

Figure 1:
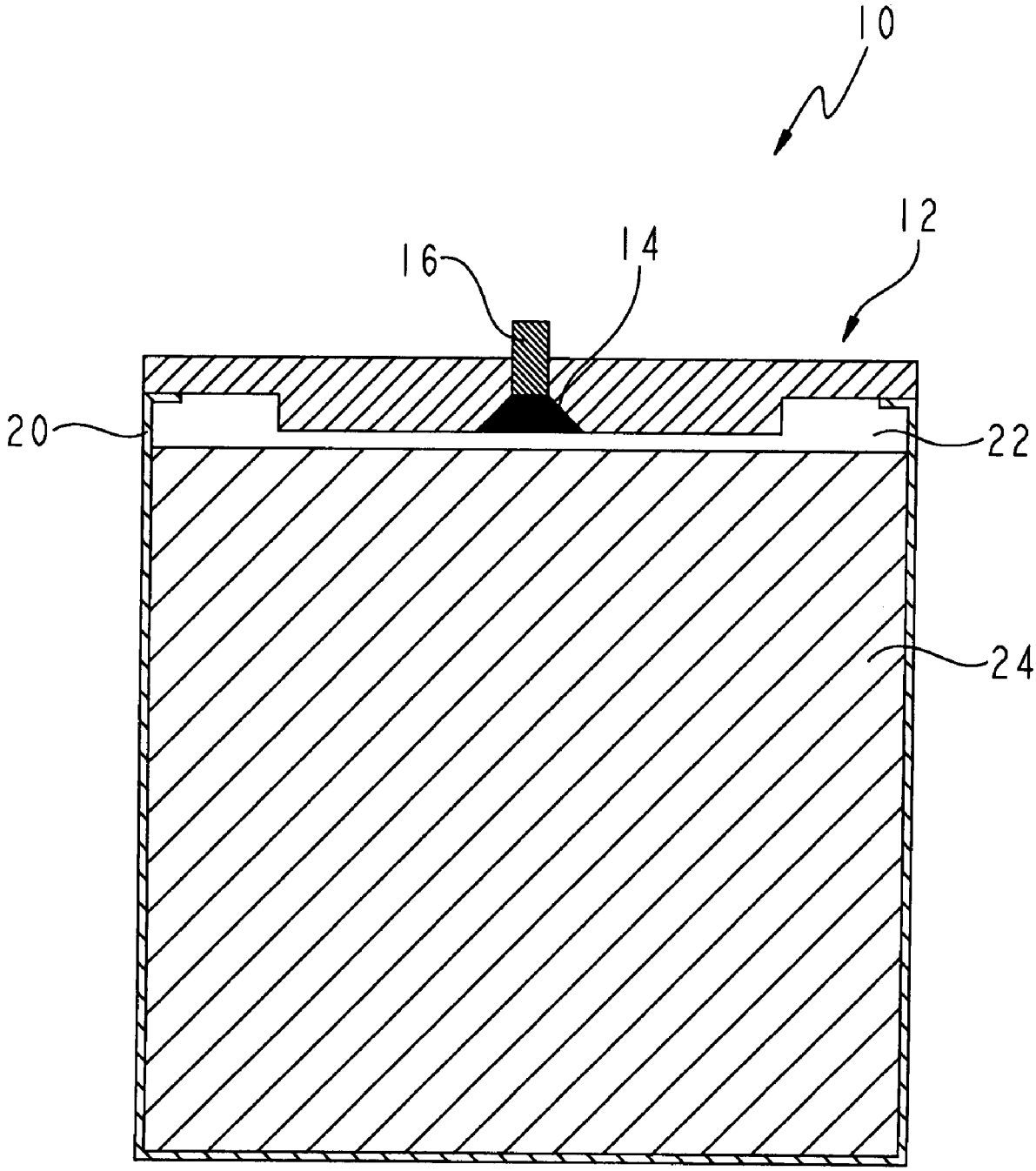
FIG. 1 (PRIOR ART)
FIG. 1 is a cross-sectional view, in partial schematic, of a conventional art explosive warhead including a fixed initiator.
Figure 2:
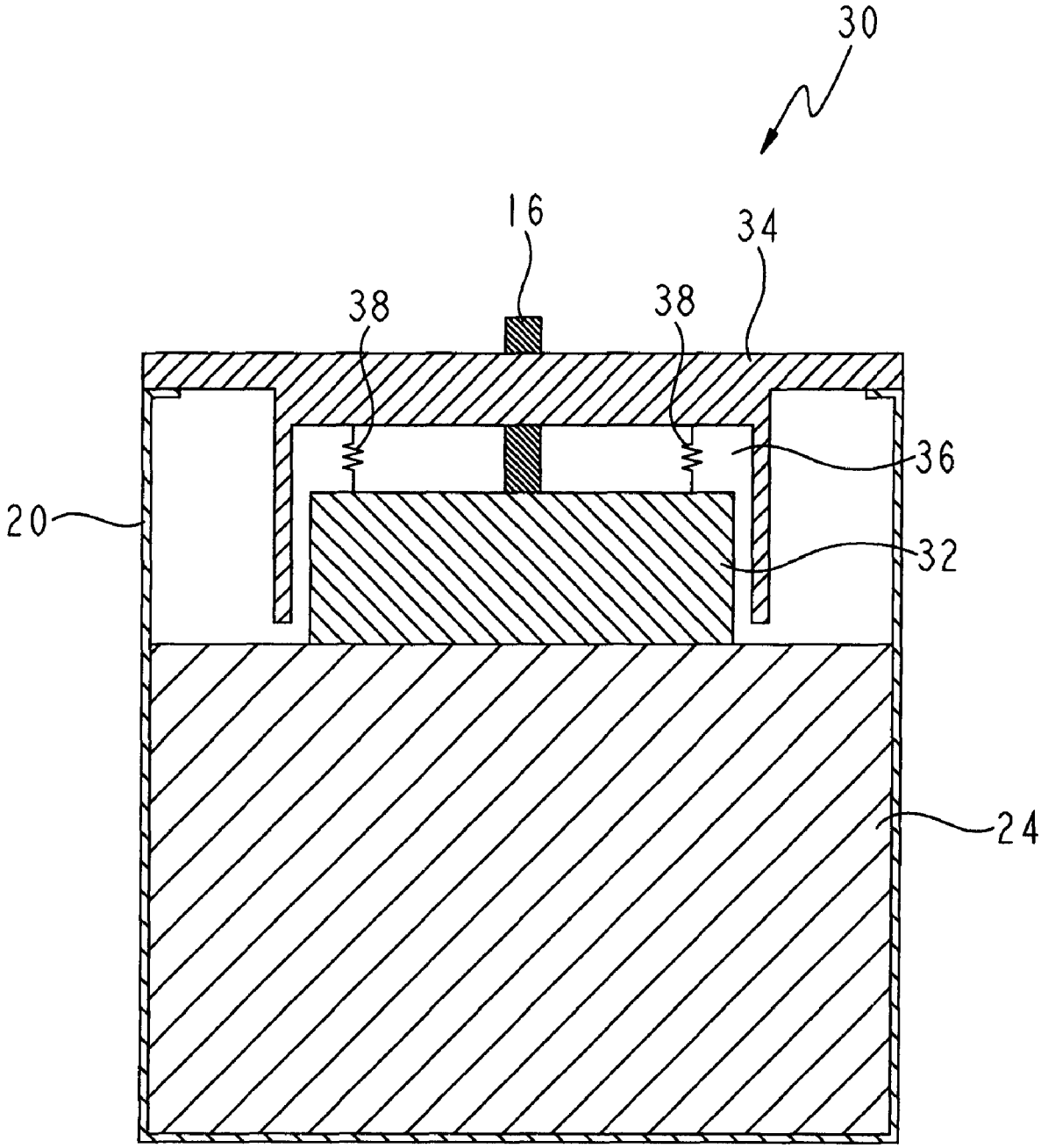
FIG. 2 (PRIOR ART)
FIG. 2 is a cross-sectional view, in partial schematic, of a conventional art warhead including a floating initiator.
Figure 3:
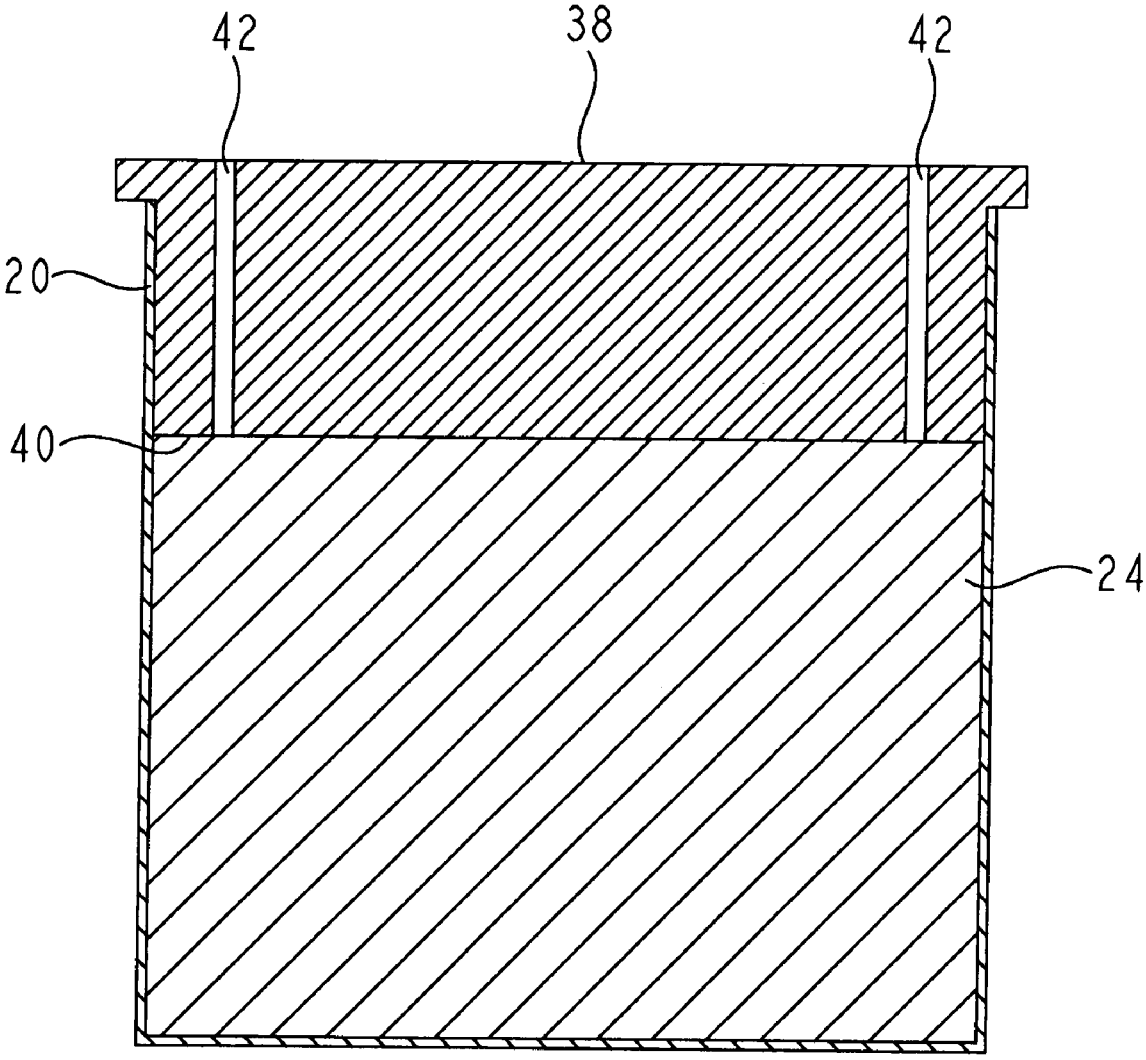
FIG. 3 (PRIOR ART)
FIG. 3 is a cross-sectional view, in partial schematic, showing an end former for forming a precision upper surface on the main explosive charge.
Figure 4:
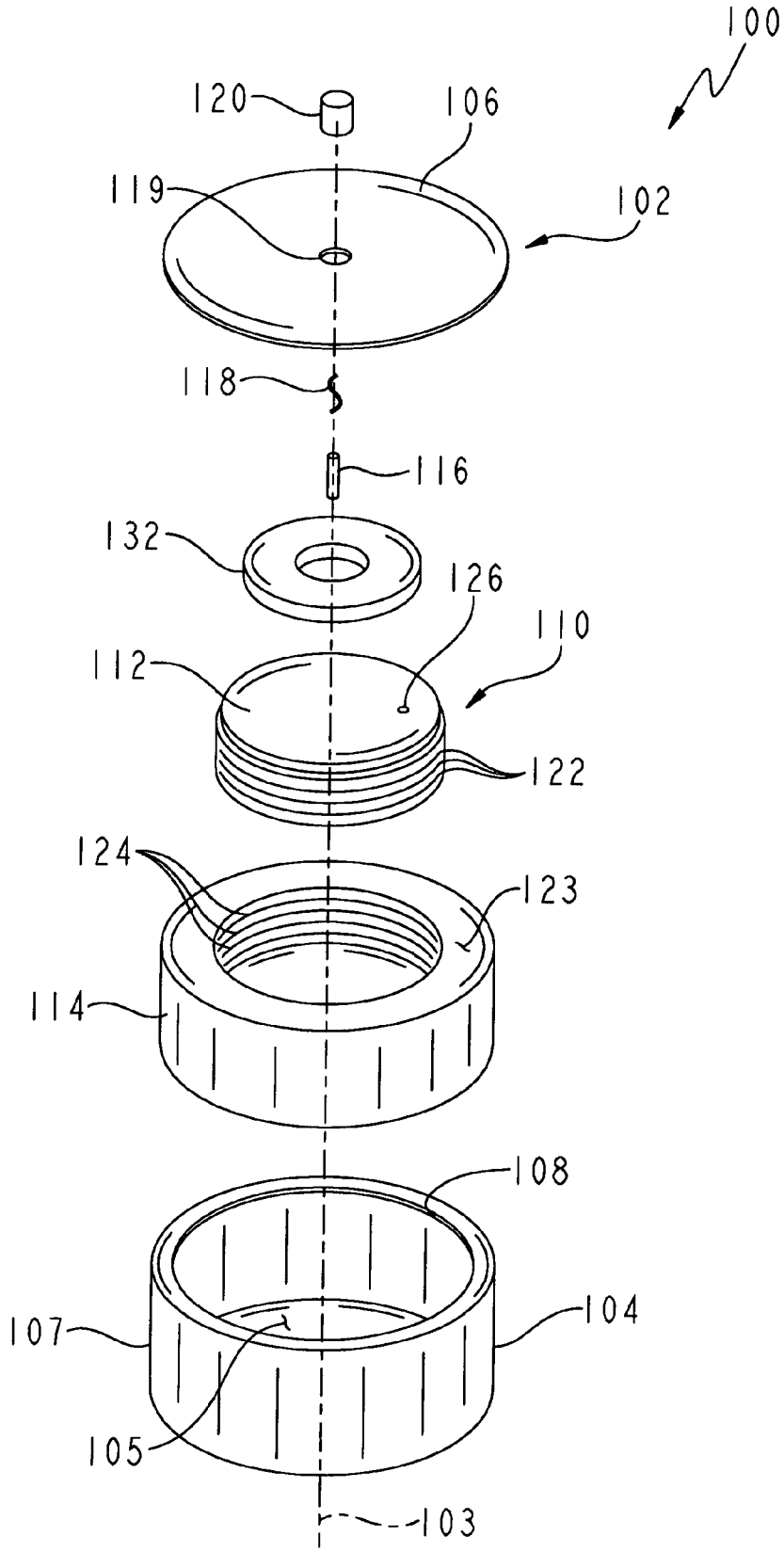
FIG. 4 is an exploded perspective view of an explosive warhead according to an illustrative embodiment of the present disclosure, having an initiator embedded within a main explosive charge.
Figure 5:
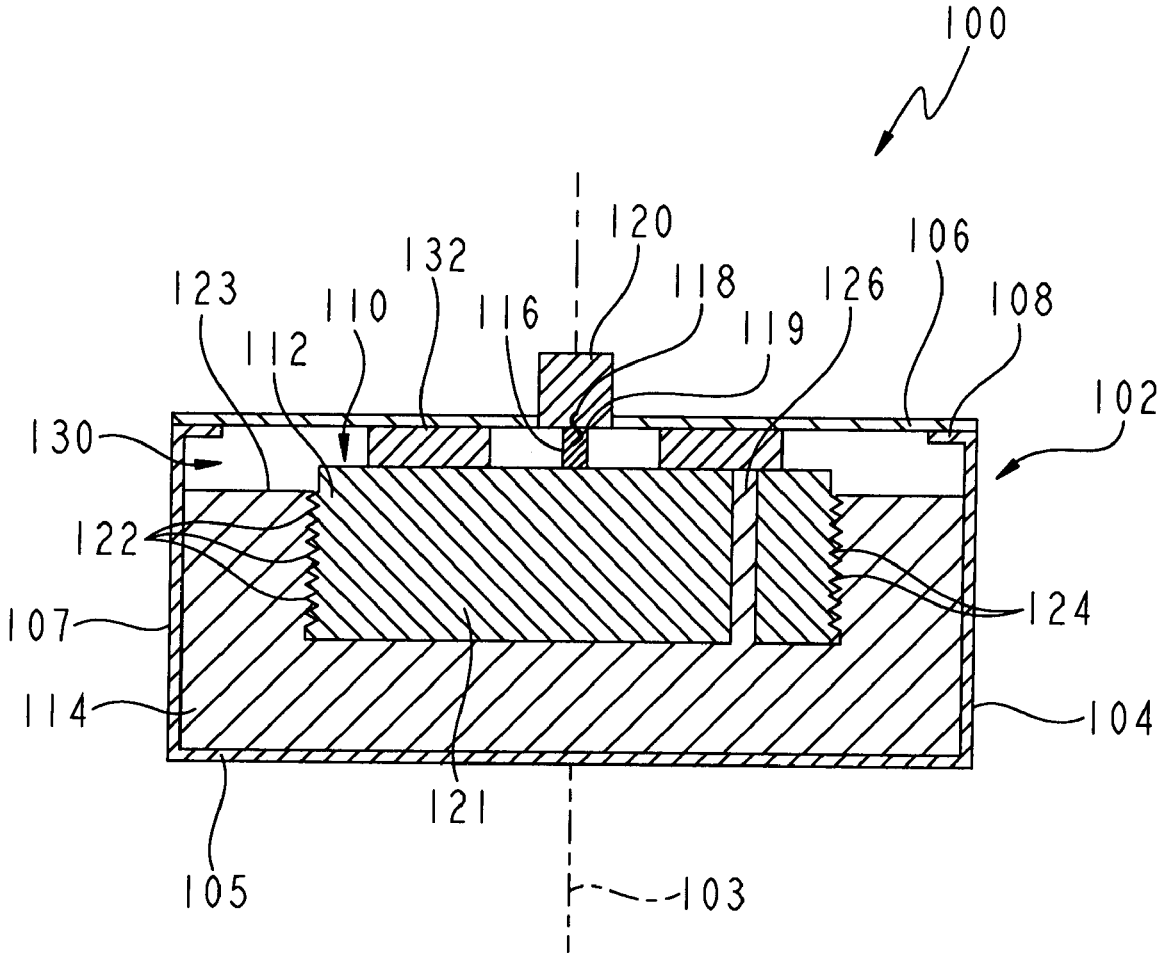
FIG. 5 is a cross-sectional view, in partial schematic, of the warhead of FIG. 4.

Referring to FIGS. 4 and 5, an illustrative warhead 100 includes a warhead case 102 defining a longitudinal axis 103. The warhead case 102 may be of conventional design, including a housing 104 and a cap or lid 106. More particularly, the housing 104 includes a cylindrical side wall 107 supporting a bottom wall 105 and a retaining flange 108. While the illustrative warhead case 102 is generally cylindrical, it should be appreciated that other shapes may also be utilized. The lid 106 may be secured to the flange 108 in a conventional manner, such as through fasteners or adhesive (not shown). The case 102 may be formed of known materials, such as aluminum if accurate dimensions are required, or thermoplastics if more dimensional tolerance is permissible. Conventional manufacturing processes may be used to form the housing 104 and lid 106.

An initiator 110 is received within the case 102 and illustratively includes a support member 112 supporting an explosive, such as an explosive booster, that is configured to cause detonation of a main explosive charge 114. Illustrative explosive boosters may be formed of pentolite or PBXN-5. As is known, pentolite is a mixture of pentaerythritol tetranitrate (PETN) and trinitrotoluene (TNT). PBXN-5 is a known plastic-bonded explosive detailed by military specification NAVY MIL-E-81111B. An illustrative main explosive charge 114 is plastic-bonded explosive PBXN-110, as detailed by military specification NAVY MIL-DTL-82901. In certain embodiments, the support member 112 itself may be formed of an explosive material and, as such, may not necessarily support a separate explosive booster. In such instances, the support member 112 may be formed of known explosives, such as PBXW-128 or LX-14. An explosive coupler 116, illustratively a precision initiation coupler ("PIC"), operably couples the initiator 110 to a flexible detonation coupler or cord 118. The flexible detonation coupler 118 is operably coupled to a conventional detonator or safe/arm device 120. The coupler 118 extends from the embedded initiator 110 through an opening 119 in the explosive cavity lid 106 and attaches to the warhead detonator or safe/arm device 120. The flexible detonation coupler 118 allows the initiator 110 to move within the warhead case 102 as the main explosive charge 114 flexes or moves due to thermal contraction and expansion.

The initiator 110 illustratively includes a lower portion 121 embedded within the explosive charge 114. In other words, the lower portion 121 is positioned below an upper surface 123 of the explosive charge 114 (FIG. 5). The lower portion 121 of the initiator 110 illustratively includes a plurality of external threads 122 which operably couple with mating internal threads 124 formed within the main explosive charge 114. The cooperating threads 122 and 124 facilitate continuous contact between the initiator 110 and the main explosive charge 114 while permitting the initiator 110 to be removed from the main explosive charge 114. Illustratively, the explosive initiator 110 may include one or more longitudinally extending spruel holes 126. The spruel holes 126 may receive a portion of the main explosive charge 114 when liquid. As such, once the explosive charge 114 hardens, the spruel holes 126 facilitate continuous and enhanced contact between the initiator 110 and the explosive charge 114.

An ullage 130 is defined intermediate the lid 106 and the embedded initiator 110. The ullage 130 permits longitudinal movement of the initiator 110 in response to movement of the main explosive charge 114 due to thermal expansion and contraction. A biasing member 132, illustratively a resilient ring, is received within the ullage 130 intermediate the lid 106 and the initiator 110. The biasing member 132 exerts a longitudinally downward force against the initiator 110, thereby facilitating continuous contact between the initiator 110 and the main explosive charge 114, particularly during occurrences of force or vibration. The biasing member 132 permits the initiator 110 to float with the upper surface 123 of the main explosive charge 114 due to thermal expansion and contraction.

Figure 6:
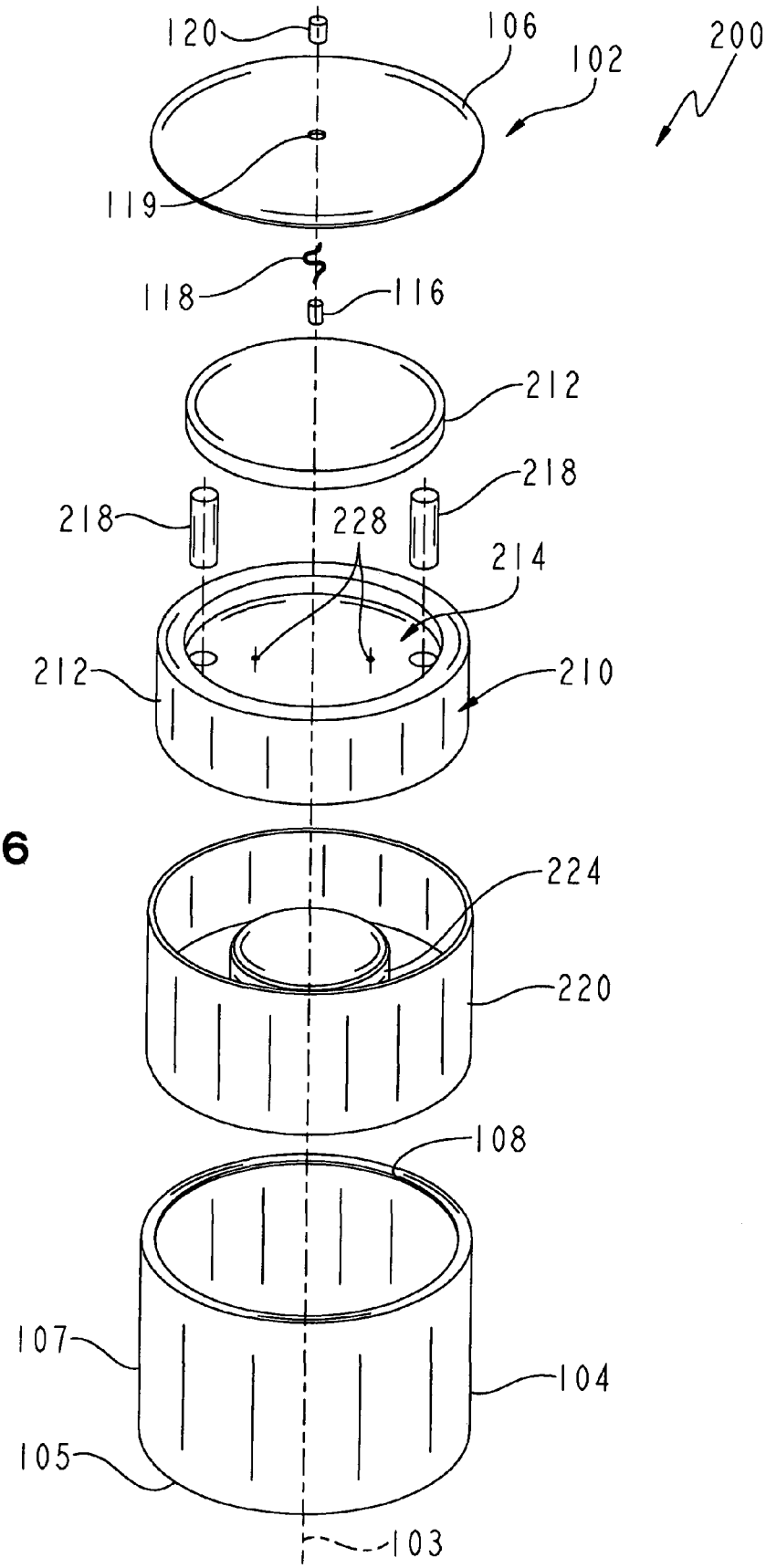
FIG. 6 is an exploded perspective view of an explosive warhead according to a further illustrative embodiment of the present disclosure, having an initiator embedded within a main explosive charge.
Figure 7:
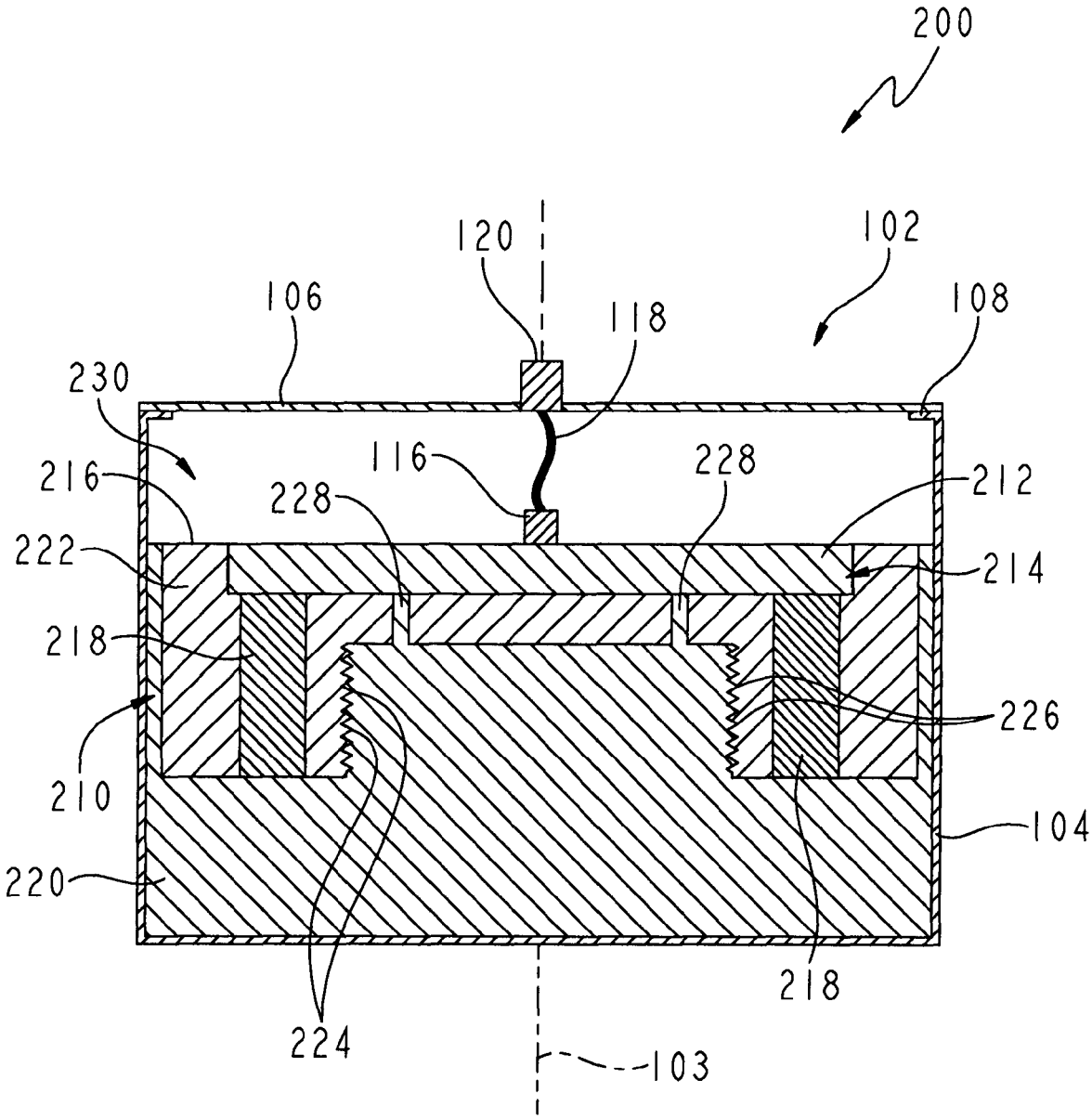
FIG. 7 is a cross-sectional view, in partial schematic, of the warhead of FIG. 6.

With reference now to FIGS. 6 and 7, a further illustrative embodiment warhead 200 is shown including many components similar to those detailed above with respect to warhead 100. As such, components of warhead 200 that are similar to those identified above with respect to warhead 100 are identified with like reference numbers. The warhead 200 includes case 102 receiving an initiator 210 having an explosive coupler 116 in communication with a detonator or safe/arm device 120 through a flexible detonation cord 118. The explosive coupler 116 may include a precision initiation coupler (PIC), which is operably coupled to an intermediate explosive charge 212, illustratively including a PBXN-301 logic charge. As known, PBXN-301 is an explosive often used in initiating devices. It is formulated from twenty percent sylgard resin system (resin plus curative) and eighty percent pentaerythritol tetranitrate (PETN). The intermediate charge is received within a recess or cavity 214 formed in an upper surface 216 of the initiator 210. Explosive boosters 218 are operably coupled to the intermediate explosive charge 212 and a main explosive charge 220. While separate boosters 218 are illustrated in FIGS. 6 and 7, it should be appreciated that any number of boosters 218 may be utilized, including a single annular booster.

The initiator 210 includes a support member 222 having internal threads 224 which cooperate with mating external threads 226 of the main explosive charge 220. Spruel holes 228 illustratively extend through the supporting member 222 of the initiator 210 and are configured to allow for the passage of the explosive charge 220 therethrough when in a liquid state. A ullage 230 is defined intermediate the upper surface of the initiator 210 and the lid 106. Again, the ullage 230 permits longitudinal movement of the initiator 210 in response to thermal expansion and contraction of the main explosive charge 220.

Figure 8:
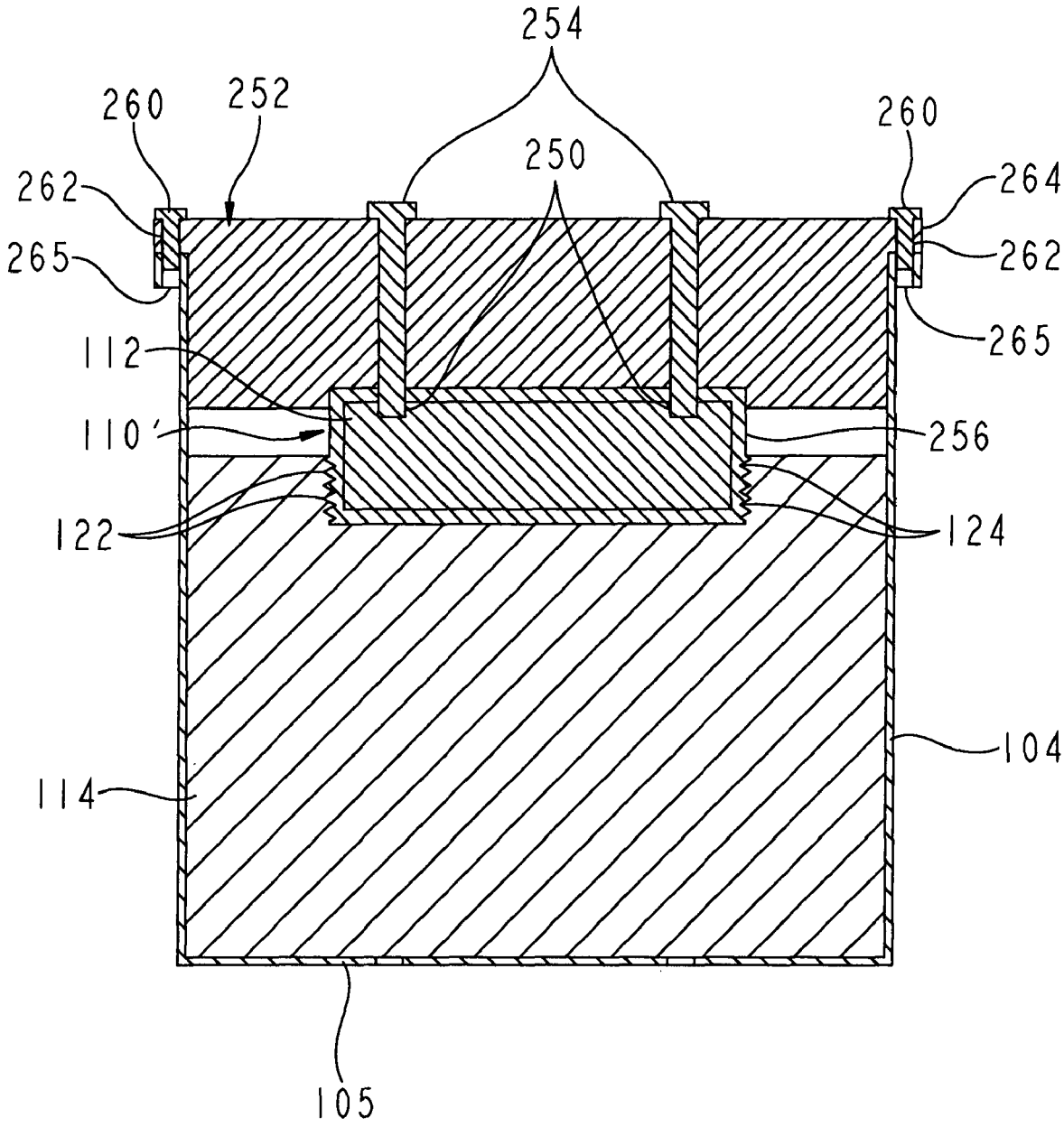
FIG. 8 is a cross-sectional view, in partial schematic, of an illustrative embodiment placement fixture embedding an initiator within a main explosive charge of a warhead.
Figure 9:
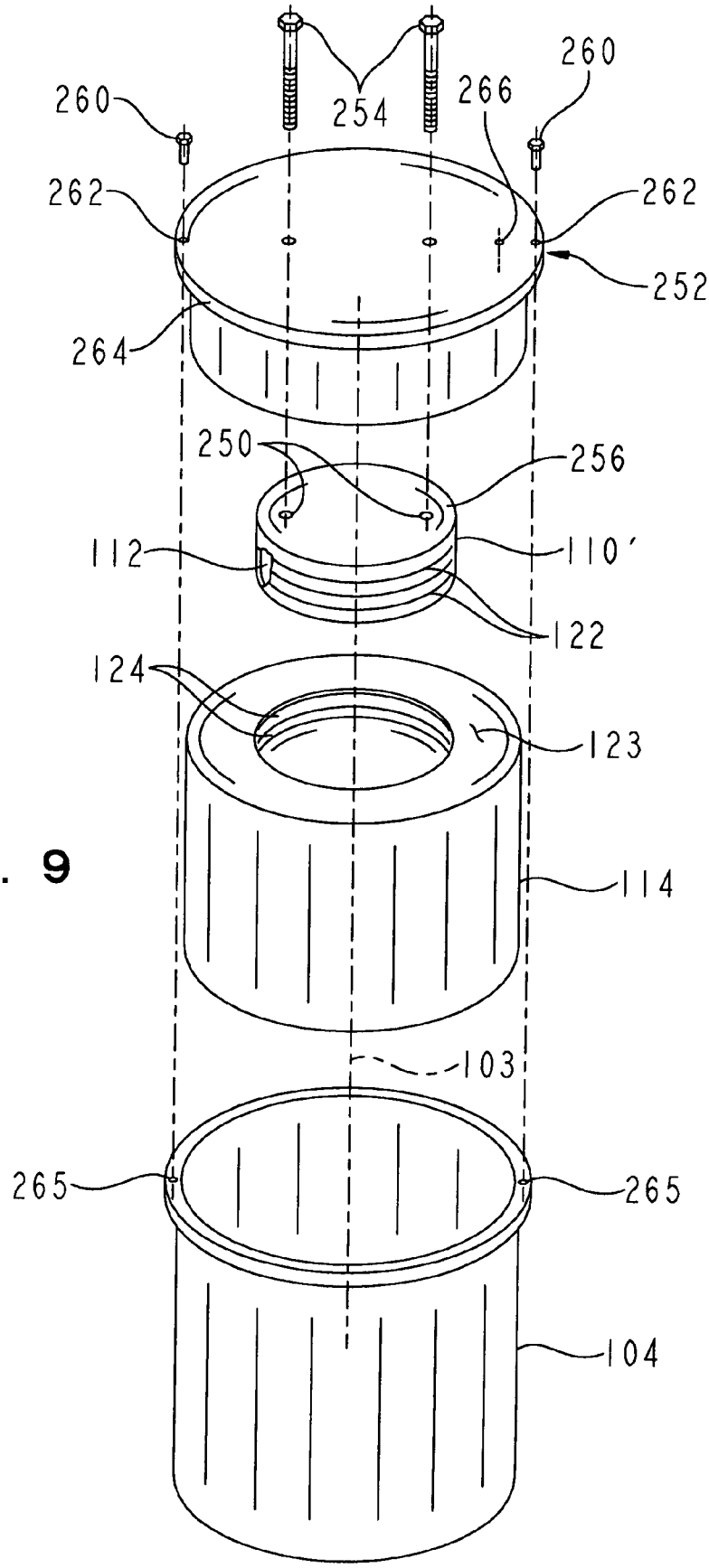
FIG. 9 is an exploded perspective view of a further illustrative embodiment placement fixture embedding an initiator within a main explosive charge of a warhead.
Figure 10:
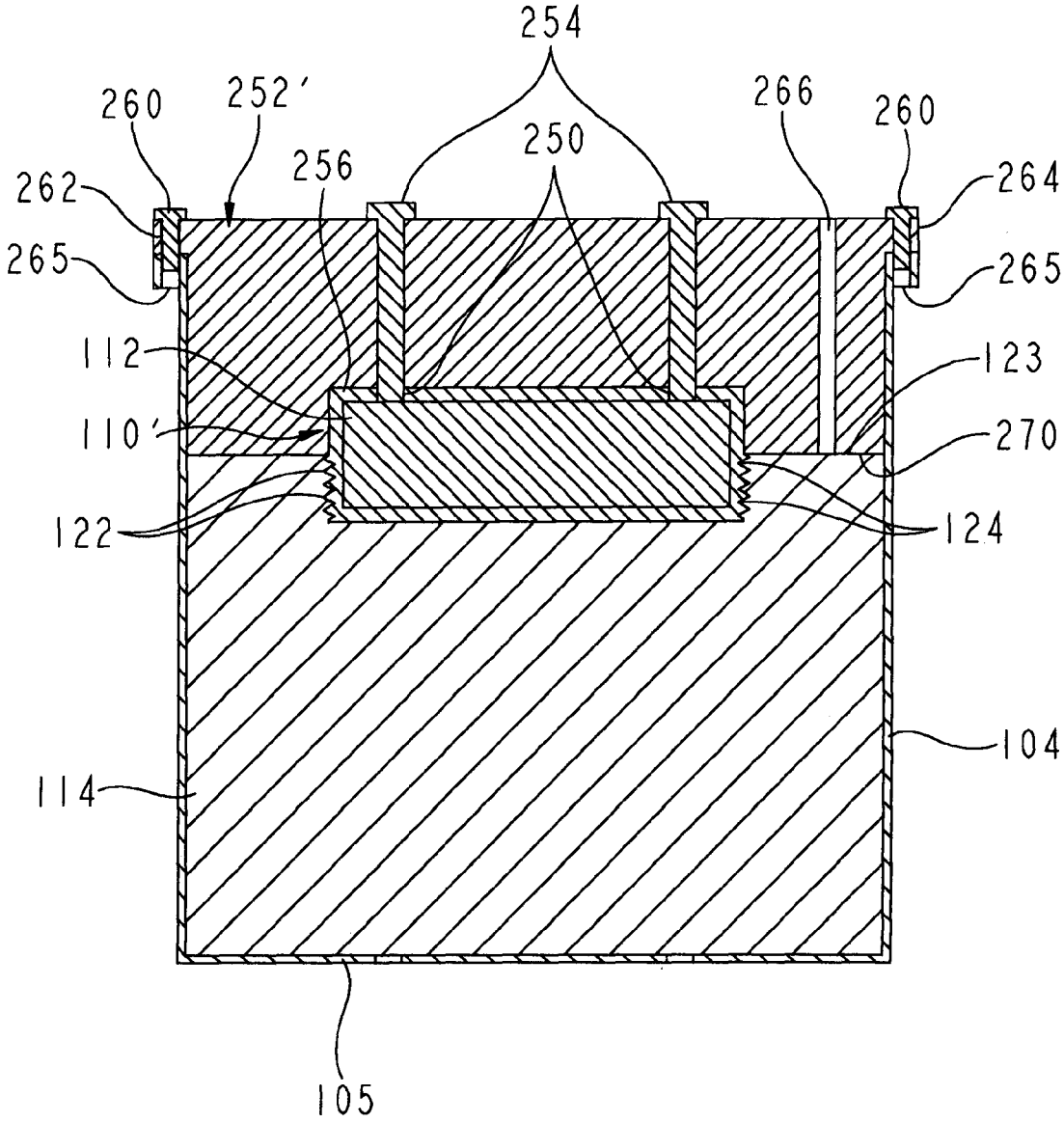
FIG. 10 is a cross-sectional view, in partial schematic, of the placement fixture and embedded initiator of FIG. 9.

With reference now to FIGS. 8-10, illustrative methods of forming a warhead 100, 200 including an embedded initiator 110' will be described. The initiator 110' may be similar to initiators 110 and 210 detailed above. Illustratively, the initiator 110' may also include an outer surface including features that will allow it to be precisely located and secured in the uncured main explosive charge 114, 220 as necessary. Such features may include fastener attachment points 250 on the outer surface of the initiator 110' for coupling to a placement fixture 252. The attachment points 250 may include threaded apertures configured to receive threaded fasteners 254. The placement fixture 252 may be a permanent part of the warhead 100, 200 or a temporary device used to secured the embedded initiator 110' to the main explosive charge 114 until the main explosive charge 114 cures (or hardens) enough to hold the embedded initiator 110' in place without assistance.

The initiator 110' may also include an outer housing 256 receiving the support member 112. Illustratively, the initiator housing 256 and the placement fixture 252 may be formed from material allowing the precision necessary for desired warhead performance. If accurate initiation location is needed, such as in the use of a shaped charge warhead, material is used allowing for high tolerance, such as aluminum. If less accurate initiation location is required, such as in fragmentation or blast warheads, materials offering less tolerance, such as thermoplastics, may be used. Consideration is also given to the contribution the initiator housing 256 material will make in regard to the energy output of the warhead 100, 200. Some materials, such as aluminum, titanium and high carbon explosives, are more reactive in combustion and will contribute more to the warhead energy output.

As noted above, there may be little or no housing 256 surrounding the initiator 110'. In such a case, the bare support member 112 and any boosters 218 may be made with fixture attachment points and located using the placement fixture 252. Bare boosters 218 may be made with a precision integral flexible detonation cord extending from it. The smaller and lighter the initiator 110' is made, the better it will stay embedded during times of warhead vibration and acceleration.

The outer surface of the initiator 110' is illustratively configured to firmly secure the embedded initiator 110' into the main explosive charge 114. For example, surface treatments or bonding agents may be supported on the exterior of the initiator 110' to promote bonding of the housing 256 to the main explosive charge 114. In one illustrative embodiment, perforations or protrusions about the housing 256 may be used to create a physical mechanical lock between the initiator 110' and the main explosive charge 114. Providing a texture or roughing up the exterior of the surface of the initiator 110' could be used to promote bonding to the explosive and ridges could be placed on the initiator side wall to lock the initiator 110' into the explosive charge 114. As noted above, threads 122 formed on the outside of the initiator 110' cause mating threads 124 to be formed within the main explosive charge 114. The cooperating threads 122 and 124 provide for uncoupling through unthreading of the initiator 110' from the main explosive charge 114 after the main explosive charge 114 has cured or hardened.

Once the initiator 110' has been properly configured, it is suspended within the housing 104 of case 102. This step may be done either before or after the housing 104 has been filled or cast with the liquid explosive charge 114. More particularly, the initiator 110' is coupled to the placement fixture 252 using the attachment points 250 on the initiator 110'. More particularly, conventional fasteners 254 may be used to couple the initiator 110' to the placement fixture 252. The placement fixture 252, in turn, is coupled to the case, illustratively by fasteners 260 extending through apertures 262 within a mounting flange 264 formed in the placement fixture 252 and threadably received within apertures 265 formed in the housing 104.

If the initiator 110' is suspended within an empty case, the explosive charge 114 is cast into the housing 104 through at least one opening 266 formed within the placement fixture 252. As shown in FIGS. 9 and 10, such an opening 266 may comprise a spruel hole configured to permit the liquid explosive charge 114 to pass therethrough. The liquid explosive charge 114 is cast to the required depth in order to achieve the desired initiator embedding. The explosive charge 114 may be cast under vacuum or with vibration as necessary to get the needed charge quality and contact with the initiator 110'. If the initiator 110' is embedded into a precast explosive charge 114, it may be attached to, the placement fixture 252, and thereby positioned within the housing 104. Vibration and vacuum may be applied after embedding as necessary for charge quality and contact between the initiator 110' and the main explosive charge 114.

In certain illustrative embodiments as shown in FIG. 10, the placement fixture 252' may include an end former defined by a substantially planar lower surface 270. The lower surface 270 is configured to produce a precise upper surface 123 on the main explosive charge 114.

Once the initiator is embedded and the placement fixture 252 is properly positioned, the explosive charge 114 is allowed to cure harden. This step is commonly done at a warm temperature, illustratively between 100° F. and 150° F., to promote faster cure. More particularly, main explosive charges comprised of plastics have a higher thermal coefficient of expansion than metal or composite cases 102 in which they are usually maintained. When the liquid explosive charge 114 and the embedded initiator 110' are warmed in a cure oven, the explosive charge 114 will rise, or move longitudinally, in regard to the position of the initiator 110' because the initiator 110' is locked in position relative to the warhead case 102 via the placement fixture 252.

After cure such that the explosive charge 114 has hardened, but before the warhead 100 is allowed to cool, the initiator 110' is illustratively disconnected from the placement fixture 252. This step will allow the initiator 110' to recede, or move longitudinally, with the explosive charge 114 as it cools in relation to the case 102 due to thermal contraction.

Rubber, epoxy or other liquid potting may be poured into the warhead case 102 and on top of the explosive surface 123 to further embed the initiator 110' and provide additional coupling between the initiator 110' and the explosive charge 114. This potting would cure solid. Prior to coupling the lid 106 to the housing 104, biasing member 132, such as a foam pad or springs, may be placed above the initiator 110'. The biasing member 132 would push again the closed lid 106 of the case 102 and provide a longitudinally downwardly extending force to keep the initiator 110' down into the explosive main charge 114 during movement, for example, due to force or vibration. Such a biasing member 132 would still allow the initiator 110' to float with the explosive surface within the ullage 130 as the surface level 123 changes in regard to the case 102 due to thermal changes.

Figure 11:
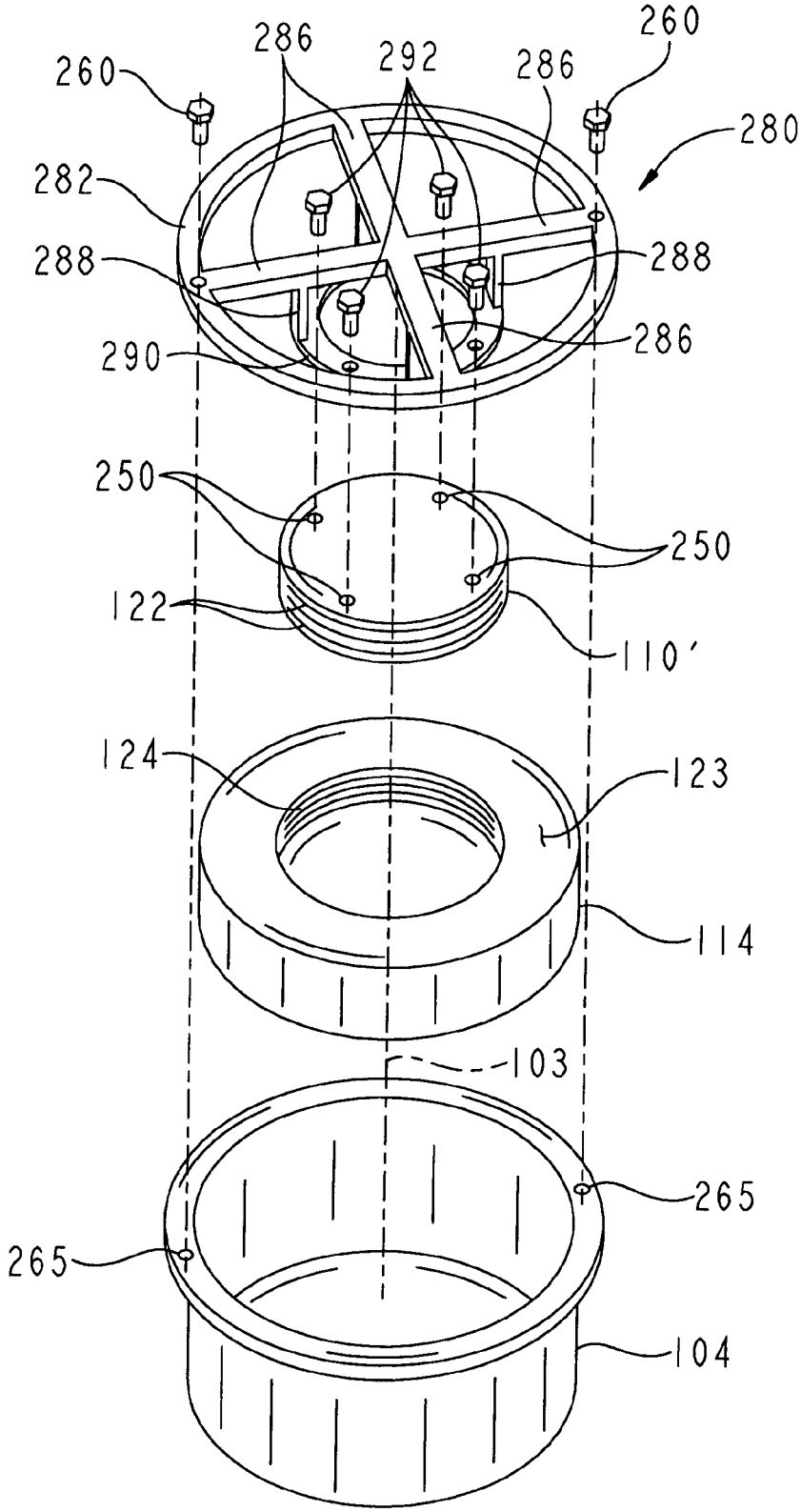
FIG. 11 is an exploded perspective view of a further illustrative embodiment placement fixture embedding an initiator within a main explosive charge of a warhead case.
Figure 12:
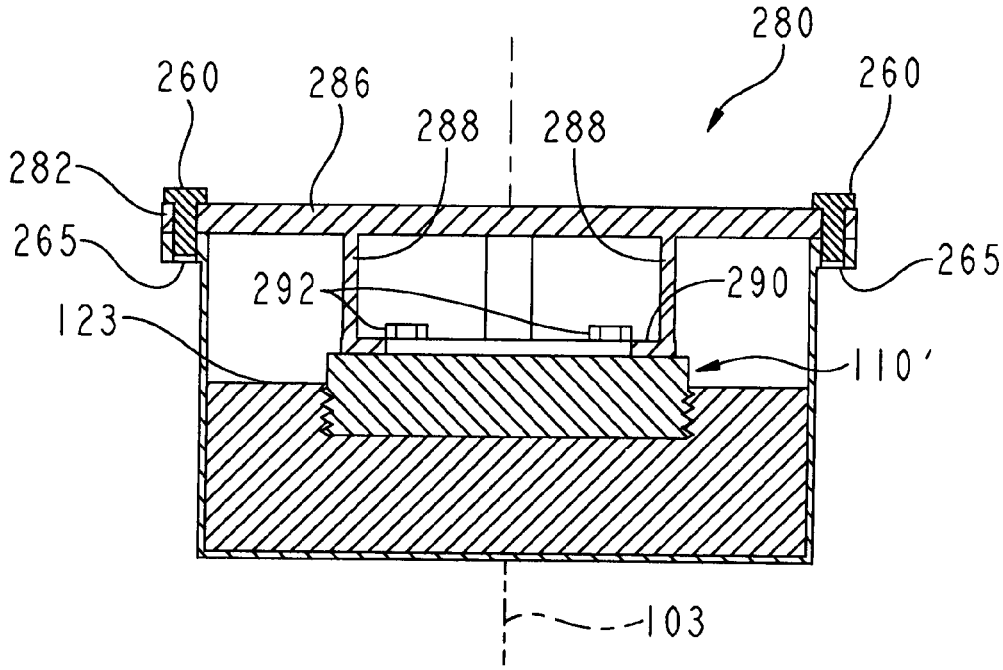
FIG. 12 is a cross-sectional view, in partial schematic, of the placement fixture and embedded initiator of FIG. 11.
Figure 13:
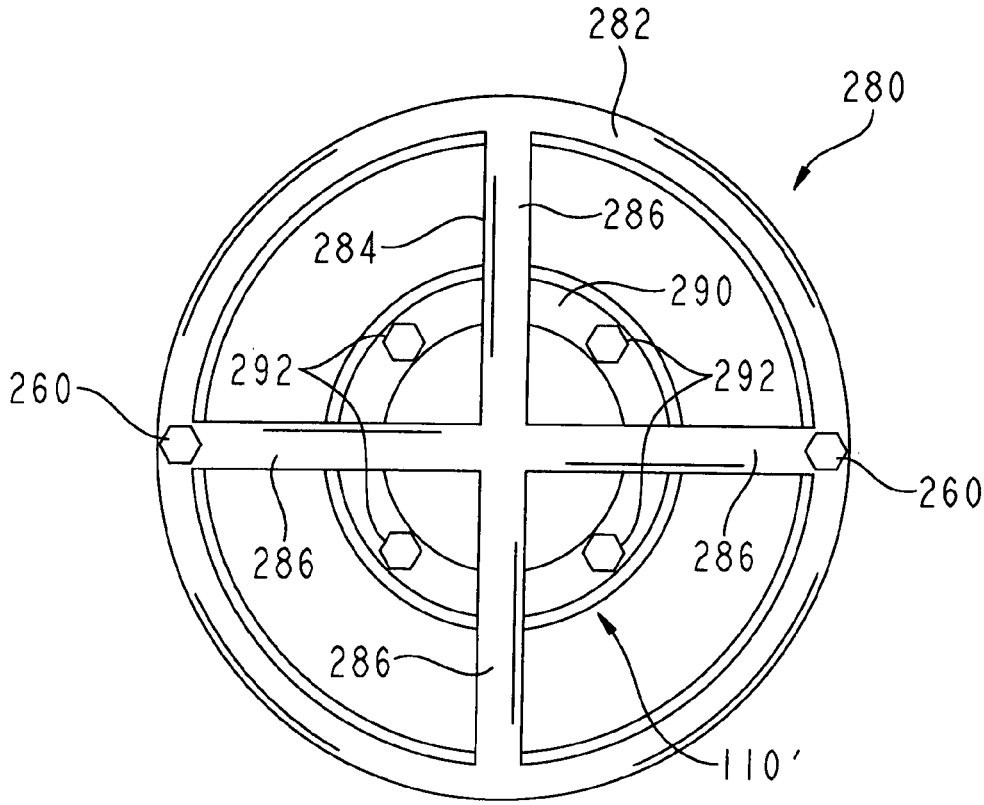
FIG. 13 is a top plan view, in partial schematic, of the placement fixture and embedded initiator of FIG. 12.

Referring now to FIGS. 11-13, a further illustrative embodiment placement fixture 280 is shown as being in the form of a spider. More particularly, the spider 280 includes an outer member 282, illustratively an annular ring, configured to be coupled to the housing 104 through conventional fasteners 260 threadably received within apertures 265 formed within the housing 104. A cross member 284 is supported by the outer member 282. More particularly, cross member 284 includes arms 286 extending radially inwardly from the outer member 282 and supports a plurality of downwardly extending legs 288 supporting an inner member 290, illustratively an annular ring. The inner member 290 is positioned below the outer member 282 and radially inwardly therefrom, and is configured to couple to the attachment points 250 of the initiator 110', illustratively through conventional fasteners 292 threadably received within apertures 250. As such, the inner member 290 supports the initiator 110' below the outer member 282 in a suspended position within the case 102. The spider 280 may be integral (non-removable) with the warhead 100 or removable once the explosive solidifies and can hold the embedded initiator 110' on its own.

A further illustrative method to place the embedded initiator 110' would be to machine or form a hole for receiving the initiator 110' after the main explosive charge 114 is cured. In another illustrative embodiment, an end former could be used to form a void in the explosive charge 114. The end former is a temporary device similar to the placement fixture 252 described above, but with an inert shaped surface to mold a surface hole in the explosive charge 114. The initiator 110' could then be pushed and seated into the formed void. It could be bonded in place or even threaded into the void, and the void in the initiator 110' were produced with screw threads. An attachment such as this would offer less precision than placement of the initiator 110' into the liquid explosive charge 114, but might have cost or other advantages.

It should be appreciated that multiple initiators may be embedded into the main explosive charge at various locations to control the direction of the explosive blast. Proper initiator placement would be based desired detonation direction. The embedded initiator could be completely submerged within the explosive with only its flexible coupler protruding.

Since the embedded initiator 110' will remain in intimate and continuous contact with the main explosive charge 114, the output of any explosive, such as boosters 218, may be reduced. In other words, there will be no air gap that needs to be jumped by the detonation wave of the initiator 110, 110', 210. As such, some IMAD (insensitive munitions advanced development) compliant boosters may be usable in this configuration. These boosters are resistant to bullet impact and other unintended initiation stimuli, but sometimes need to be very close to the main charge (not good gap jumpers). The use of an IMAD booster may substantially increase the safety of the warhead 100, 200. Not only can any air gap between the booster 218 and the main explosive charge 114, 220 be eliminated, but the booster 218 itself may be embedded without any barrier between it and the main explosive charge 114, 220.

Although the invention has been described in detail with reference to certain exemplary embodiments, variations and modifications exist within the spirit and scope of the invention as described and defined in the following claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An explosive warhead comprising:

a case defining a longitudinal axis;

a main explosive charge received within the case;

an explosive initiator including an embedded portion received within the main explosive charge; and a coupler being positioned intermediate the main explosive charge and a detonator, the coupler releasably couples the detonator to the explosive initiator, wherein the explosive initiator maintains continuous contact with the main explosive charge by moving longitudinally with the main explosive charge during thermal expansion and contraction, and wherein the explosive initiator is integral and attached to the main explosive charge so as to maintain a continuous contact position relative to the main explosive charge.

2. The explosive warhead of claim 1, wherein the explosive initiator includes a plurality of threads formed within the main explosive charge, and a plurality of mating threads supported by the embedded portion of the explosive initiator.

3. The explosive warhead of claim 1, wherein the explosive initiator includes at least one longitudinally extending spruel hole receiving a portion of the main explosive charge.

4. The explosive warhead of claim 1, wherein the initiator includes a plurality of attachment points positioned above the embedded portion and configured to be operably coupled to an assembly fixture.

5. The explosive warhead of claim 1, further comprising a detonator, wherein the explosive initiator includes an explosive coupler operably coupled to the detonator.

6. The explosive warhead of claim 5, further comprising a flexible detonation cord operably coupling the detonator and the explosive coupler, thereby permitting the explosive initiator to move longitudinally as the main explosive charge flexes due to thermal expansion and contraction.

7. The explosive warhead of claim 1, wherein the initiator includes a supporting material and at least one explosive booster received within the supporting material.

8. The explosive warhead of claim 1, wherein the embedded portion of the explosive initiator has an outer surface, the outer surface including a surface treatment to promote bonding of the explosive initiator to the main explosive charge.

9. The explosive warhead of claim 1, further comprising a biasing member positioned intermediate the case and the explosive initiator and applying a longitudinal force against the explosive initiator in a direction toward the main explosive charge.

10. An explosive warhead, comprising:

a case defining a longitudinal axis;

a main explosive charge received within the case;

an explosive initiator including an embedded portion received within the main explosive charge;

a coupler; and a longitudinally extending spruel hole within the initiator and receiving a portion of the main explosive charge, wherein the explosive initiator is integral and attached to the main explosive charge so as to maintain a continuous contact position relative to the main explosive charge.

11. The explosive warhead of claim 10, wherein said coupler positioned intermediate the main explosive charge and a detonator, the coupler releasably couples the detonator to the explosive initiator.

12. The explosive warhead of claim 11, wherein the explosive initiator includes a plurality of threads formed within the main explosive charge, and a plurality of mating threads supported by the embedded portion of the explosive initiator.

13. The explosive warhead of claim 10, further comprising a ullage intermediate the explosive initiator and the case, wherein the explosive initiator maintains continuous contact with the main explosive charge by moving within the ullage during thermal expansion and contraction of the main explosive charge.

14. The explosive warhead of claim 10, wherein the initiator includes a plurality of attachment points positioned above the embedded portion and configured to be operably coupled to an assembly fixture.

15. The explosive warhead of claim 10, further comprising a detonator, wherein the explosive initiator includes an explosive coupler operably coupled to the detonator.

16. The explosive warhead of claim 15, further comprising a flexible detonation cord operably coupling the detonator and the explosive coupler, thereby permitting the explosive initiator to move longitudinally as the main explosive charge flexes due to thermal expansion and contraction.

17. The explosive warhead of claim 10, wherein the initiator includes a supporting material and at least one explosive booster received within the supporting material.

18. The explosive warhead of claim 10, wherein the embedded portion of the explosive initiator has an outer surface, the outer surface includes a surface treatment to promote bonding of the explosive initiator to the main explosive charge.

19. The explosive warhead of claim 10, further comprising a biasing member positioned intermediate the case and the explosive initiator and applying a longitudinal force against the explosive initiator in a direction toward the main explosive charge.

20. An explosive warhead, comprising:

a case;

a main explosive charge received within the case;

an explosive initiator including an embedded portion received within the main explosive charge;

a coupler; and a ullage intermediate the explosive initiator and the case, wherein the explosive initiator is integral and attached to the main explosive charge so that the explosive initiator maintains continuous contact with the main explosive charge by moving within the ullage during thermal expansion and contraction of the main explosive charge.

21. The explosive warhead of claim 20, wherein said coupler positioned intermediate the main explosive charge and a detonator, the coupler releasably couples the detonator to the explosive initiator.

22. The explosive warhead of claim 21, wherein the explosive initiator includes a plurality of threads formed within the main explosive charge, and a plurality of mating threads supported by the embedded portion of the explosive initiator.

23. The explosive warhead of claim 20, further comprising at least one longitudinally extending spruel hole within the explosive initiator and receiving a portion of the main explosive charge.

24. The explosive warhead of claim 20, further comprising a detonator, wherein the explosive initiator includes an explosive coupler operably coupled to the detonator.

25. The explosive warhead of claim 24, further comprising a flexible detonation cord operably coupling the detonator and the explosive coupler, thereby permitting the explosive initiator to move longitudinally as the main explosive charge flexes due to thermal expansion and contraction.

26. The explosive warhead of claim 20, wherein the initiator includes a supporting material and at least one explosive booster received within the supporting material.

27. The explosive warhead of claim 20, wherein the embedded portion of the explosive initiator has an outer surface, the outer surface including a surface treatment to promote bonding of the explosive initiator to the main explosive charge.

28. The explosive warhead of claim 20, further comprising a biasing member within the ullage intermediate the case and the explosive initiator and applying a longitudinal force against the explosive initiator in a direction toward the main explosive charge.

* * * * *